US011702182B2

(12) United States Patent
Vähätalo et al.

(10) Patent No.: US 11,702,182 B2
(45) Date of Patent: Jul. 18, 2023

(54) METHOD AND ARRANGEMENT FOR SEALING A PROPELLER SHAFT LOCATED UNDER WATER

(71) Applicant: ABB Schweiz AG, Baden (CH)

(72) Inventors: Veikko Vähätalo, Hämeenlinna (FI); Jukka Laine, Helsinki (FI); Otto Maja, Lahti (FI); Toni Niska, Vantaa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/650,467

(22) Filed: Feb. 9, 2022

(65) Prior Publication Data

US 2022/0274680 A1 Sep. 1, 2022

(30) Foreign Application Priority Data

Feb. 16, 2021 (EP) ..... 21157328

(51) Int. Cl.
*B63H 23/32* (2006.01)

(52) U.S. Cl.
CPC ..... *B63H 23/321* (2013.01); *B63H 2023/327* (2013.01)

(58) Field of Classification Search
CPC ..... B63H 23/321; B63H 2023/327; B63H 2005/1254; F16J 15/46
See application file for complete search history.

(56) References Cited

U.S. PATENT DOCUMENTS

| | | | | |
|---|---|---|---|---|
| 5,683,278 | A | 11/1997 | Pietsch et al. | |
| 9,937,991 | B2 | 4/2018 | Fangauf et al. | |
| 9,937,997 | B2 | 4/2018 | Himmelmann | |
| 2014/0048461 | A1* | 2/2014 | Wrage | F16J 15/3232 210/167.02 |

(Continued)

FOREIGN PATENT DOCUMENTS

| | | | |
|---|---|---|---|
| DE | 4434247 | A1 | 3/1996 |
| EP | 189829 | A2 | 8/1986 |

(Continued)

OTHER PUBLICATIONS

Japanese Office Action Translation; Applicaton No. 2022-021865; Completed: Dec. 23, 2022; dated Jan. 10, 2023; 5 Pages.

(Continued)

*Primary Examiner* — Andrew Polay
(74) *Attorney, Agent, or Firm* — Whitmyer IP Group LLC

(57) ABSTRACT

A method and an arrangement for sealing a propeller shaft located under water. The propeller shaft is arranged at a pod of a ship and an air chamber is provided circumferentially around the propeller shaft. The method includes supplying compressed air from a compressed air source to the air chamber, discharging compressed air from the air chamber in an air return line and colleting liquid present in the compressed air discharged from the air chamber in an intermediate leakage tank that is provided in the air return line. The method includes closing the air return line upstream of the intermediate leakage tank, and supplying compressed air to the intermediate leakage tank to effect flowing of liquid present in the intermediate leakage tank to a leakage tank.

15 Claims, 4 Drawing Sheets

(56) References Cited

U.S. PATENT DOCUMENTS

| | | | | |
|---|---|---|---|---|
| 2014/0346738 | A1* | 11/2014 | Rusch | F16J 15/004 29/401.1 |
| 2017/0259898 | A1* | 9/2017 | Fangauf | F16J 15/441 |
| 2022/0221059 | A1* | 7/2022 | Matsuoka | F16J 15/3204 |

FOREIGN PATENT DOCUMENTS

| | | | |
|---|---|---|---|
| EP | 1213221 | A1 | 6/2002 |
| JP | 04004567 | B | 1/1992 |
| JP | 06008882 | A | 1/1994 |
| JP | H07242198 | A | 9/1995 |
| JP | 07310829 | A | 11/1995 |
| JP | 11304005 | A | 11/1999 |
| JP | 2002234493 | A | 8/2002 |
| JP | 2003127988 | A | 5/2003 |
| JP | 2006234101 | A | 9/2006 |

OTHER PUBLICATIONS

Extended European Search Report; Application No. EP 21 15 7328; dated Aug. 17, 2021; 2 Pages.

Federal Service on Intellectual Property Federal State Budgetary Enterprise "Federal Institute of Industrial Property" (FIPS) Search Report; Application No. 2022103745; dated Jun. 28, 2022; 4 pages.

* cited by examiner

METHOD AND ARRANGEMENT FOR SEALING A PROPELLER SHAFT LOCATED UNDER WATER

TECHNICAL FIELD

The invention relates to a method for sealing a propeller shaft located under water. The invention also relates to an arrangement for sealing a propeller shaft located under water.

BACKGROUND

Publication U.S. Pat. No. 9,937,997 presents a sealing system, a method, and a watercraft.

SUMMARY

The object of the invention is to provide an improved method and an improved arrangement for sealing a propeller shaft located under water.

The arrangement and method of the invention are characterized by the definitions of the independent claims Preferred embodiments of the arrangement and method are defined in the dependent claims.

BRIEF DESCRIPTION OF THE DRAWINGS

In the following the invention will described in more detail by referring to the figures, of which

DETAILED DESCRIPTION

Figure 1:
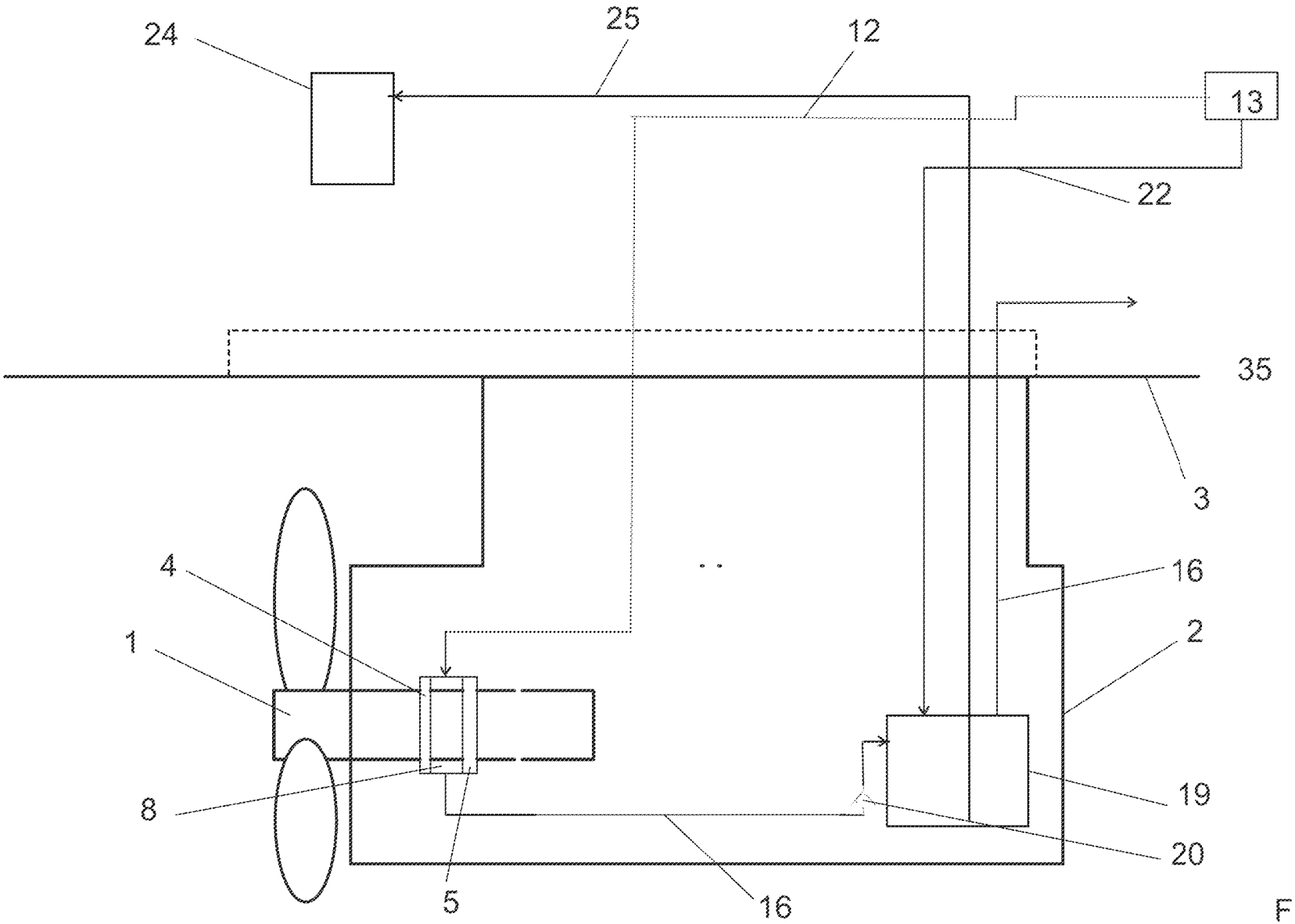
FIG. 1 is a schematic illustration of a first embodiment of the invention.

First the method for sealing a propeller shaft 1 located under water and some embodiments and variants of the method will be described in greater detail.

In the method the propeller shaft 1 is arranged at a pod 2 that is suspended at a hull 3 of a ship and an air chamber 8 is provided circumferentially around the propeller shaft 1. The pod 2 can be pivotable suspended at the hull 3 of a ship.

The method comprises supplying compressed air from a compressed air source 13 in an air supply line 12 to the air chamber 8. Compressed air means in this context air, gas, or any mixture thereof.

The pressure in the air chamber 8 is provided circumferentially around the propeller shaft 1 is preferably, but not necessarily, about 0.2 to about 0.6 bar higher than a pressure in a pod housing of the pod 2 such as in a pod housing limited by a shell structure (not marked with a reference number) of the pod 2.

The pressure of the compressed air supplied from the compressed air source 12 to the air supply line can be in the range of about 3 to about 10 bar.

The method comprises discharging compressed air from the air chamber 8 in an air return line 16 and out of the air return line 16

The method comprises collecting liquid present in the compressed air discharged from the air chamber 8 in an intermediate leakage tank 19 that is provided in the air return line 16 within a pod housing of the pod 2.

The method comprises closing the air return line 16 upstream of the intermediate leakage tank 19 and supplying compressed air to the intermediate leakage tank 19 effect flowing of liquid present in the intermediate leakage tank 19 in to a leakage tank 24. The leakage tank 24 can be arranged within the hull 3 of the ship or within the pod housing of the pod 2. The pressure of the compressed air that is supplied to the intermediate leakage tank 19 effect flowing of liquid present in the intermediate leakage tank 19 in to a leakage tank 24 is preferably, but not necessarily, in the range of about 1 bar to about 3 bar.

Said closing of the air return line 16 upstream of the intermediate leakage tank 19 can be done by closing a first valve 20 in the air return line 16 upstream of the intermediate leakage tank 19.

Said supplying of compressed air to the intermediate leakage tank 19 can be done by supplying compressed air to the intermediate leakage tank 19 in a connecting air line 22 that is provided as a separate line, which sole function is to supply compressed air to the intermediate leakage tank 19 effect flowing of liquid present in the intermediate leakage tank 19 in to the leakage tank 24.

Said closing of the air return line 16 upstream of the intermediate leakage tank 19 and said supplying of compressed air to the intermediate leakage tank 19 effect flowing of liquid present in the intermediate leakage tank 19 in to a leakage tank 24 is preferably, but not necessarily, performed in regular time intervals such as once every hour.

Alternatively can the connecting air line 22 be provided as a line that connects the air supply line 12, that supplies compressed air from the compressed air source 13 to the air chamber 8 provided circumferentially around the propeller shaft 1, and the air return line 16, that discharges compressed air from the air chamber 8 provided circumferentially around the propeller shaft 1, so that said supplying compressed air to the intermediate leakage tank 19 to effect flowing of liquid present in the intermediate leakage tank 19 in to a leakage tank 24, is performed so that compressed air fed from the compressed air source 12 flows first partly in the air supply line 12, thereafter flows in the connecting air line 22 and thereafter flows in the air return line 16 to the intermediate leakage tank 19 effect flowing of liquid present in the intermediate leakage tank 19 in to a leakage tank 24.

Liquid can flow from the intermediate leakage tank 19 to the leakage tank 24 in a connecting liquid line 25.

The method allows thus to drain the intermediate leakage tank 19 in a controller manner without a need to entering the pod 2, provided that the leakage tank 24 is provided within the hull 3 of the ship. Alternatively, the leakage tank 24 can be provided within the pod housing of the pod 2 in a location that is easily accessible. Draining of the intermediate leakage tank 19 is preferably, but not necessarily, made while supplying compressed air from the compressed air source 13 to the air chamber 8 in the air supply line 12 so that a sufficient pressure against water surrounding the pod is maintained in the air chamber 8 circumferentially surrounding the propeller shaft 8.

The method comprises preferably, but not necessarily, closing the air return line 16 downstream of the intermediate leakage tank 19 in connection with closing the air return line 16. Such closing of the air return line 16 downstream of the intermediate leakage tank 19 prevents fluid from being discharged out of the air return line 16 when supplying pressurized air in the connecting air line 22 to the intermediate leakage tank 19. Said closing of the air return line 16 downstream of the intermediate leakage tank 19 can be done by closing a second valve 17 in the air return line 16 downstream of the intermediate leakage tank 19. The method comprises preferably, but not necessarily arranging, the possible second valve 17 of the air return line 16 outside the pod 2 and within the hull 3 of the ship.

If the method comprises closing a second valve 17 in the air return line 16 downstream of the intermediate leakage tank 19 in connection with closing the first valve 20 in the air return line 16, the method comprises preferably, but not necessarily, supplying said compressed air in the connecting air line 22 to the intermediate leakage tank 19 by supplying compressed air to an upstream end 34 of the connecting air line 22 from the air supply line 12 supplying compressed air from the compressed air source 13 to the air chamber 8 provided circumferentially around the propeller shaft 1, and by supplying compressed air from a downstream end 35 of the connecting air line 22 into the air return line 16 at a point of the air return line 16 downstream of the intermediate leakage tank 19 and upstream of the second valve 17, and by supplying compressed air in the air return line 16 to the intermediate leakage tank 19 to effect said flowing of liquid present in the intermediate leakage tank 19 to the leakage tank 24 in the connecting liquid line 25.

If the method comprises closing the second valve 17 in the air return line 16 downstream of the intermediate leakage tank 19 in connection with closing the first valve 20 in the air return line 16, and if the method comprises supplying said compressed air in the connecting air line 22 to the intermediate leakage tank 19 by supplying compressed air to an upstream end 34 of the connecting air line 22 from the air supply line 12 supplying compressed air from the compressed air source 13 to the air chamber 8 provided circumferentially around the propeller shaft 1, and by supplying compressed air from a downstream end 35 of the connecting air line 22 into the air return line 16 at a point of the air return line 16 downstream of the intermediate leakage tank 19 and upstream of the second valve 17, and by supplying compressed air in the air return line 16 to the intermediate leakage tank 19 to effect said flowing of liquid present in the intermediate leakage tank 19 to the leakage tank 24 in the connecting liquid line 25, the method comprises preferably, but not necessarily, supplying compressed air from the compressed air source 13 to the air chamber 8 through a first pressure regulator 14 in the air supply line 12 and supplying compressed air in the connecting air line 22 through a second pressure regulator 23 configured to provide a higher pressure than the first pressure regulator 12 in the air supply line 12. In such embodiment of the method, the method comprises preferably, but not necessarily, arranging the first pressure regulator 14 of the air supply line 12 outside the pod 2 and within the hull 3 of the ship. In such embodiment of the method, the method comprises preferably, but not necessarily, arranging the second pressure regulator 23 in the connecting air line 22 outside the pod 2 and within the hull 3 of the ship.

If the method comprises closing the second valve 17 in the air return line 16 downstream of the intermediate leakage tank 19 in connection with closing the first valve 20 in the air return line 16, and if the method comprises supplying said compressed air in the connecting air line 22 to the intermediate leakage tank 19 by supplying compressed air to an upstream end 34 of the connecting air line 22 from the air supply line 12 supplying compressed air from the compressed air source 13 to the air chamber 8 provided circumferentially around the propeller shaft 1, and by supplying compressed air from a downstream end 35 of the connecting air line 22 into the air return line 16 at a point of the air return line 16 downstream of the intermediate leakage tank 19 and upstream of the second valve 17, and by supplying compressed air in the air return line 16 to the intermediate leakage tank 19 to effect said flowing of liquid present in the intermediate leakage tank 19 to the leakage tank 24 in the connecting liquid line 25, the method comprises preferably, but not necessarily, supplying compressed air from the compressed air source 13 to the air chamber 8 through a first pressure regulator 14 in the air supply line 12 and supplying compressed air in the connecting air line 22 through a second pressure regulator 23 configured to provide a higher pressure than the first pressure regulator 12 in the air supply line 12 and providing a check valve as the first valve 20 in the air return line 16 upstream of the intermediate leakage tank 19, wherein said closing of the first valve 20 in the return air line 16 upstream of the intermediate leakage tank 19 is effected by the difference between the pressure provided by the first pressure regulator 14 in the air supply line 12 and the pressure provided by the second pressure regulator 23 in the connecting air line 22. In such embodiment of the method, the method comprises preferably, but not necessarily, arranging the first pressure regulator 14 of the air supply line 12 outside the pod 2 and within the hull 3 of the ship. In such embodiment of the method, the method comprises preferably, but not necessarily, arranging the second pressure regulator 23 in the connecting air line 22 outside the pod 2 and within the hull 3 of the ship.

If the method comprises closing the second valve 17 in the air return line 16 downstream of the intermediate leakage tank 19 in connection with closing the first valve 20 in the air return line 16, and if the method comprises supplying said compressed air in the connecting air line 22 to the intermediate leakage tank 19 by supplying compressed air to an upstream end 34 of the connecting air line 22 from the air supply line 12 supplying compressed air from the compressed air source 13 to the air chamber 8 provided circumferentially around the propeller shaft 1, and by supplying compressed air from a downstream end 35 of the connecting air line 22 into the air return line 16 at a point of the air return line 16 downstream of the intermediate leakage tank 19 and upstream of the second valve 17, and by supplying compressed air in the air return line 16 to the intermediate leakage tank 19 to effect said flowing of liquid present in the intermediate leakage tank 19 to the leakage tank 24 in the connecting liquid line 25, the method comprises preferably, but not necessarily, monitoring the pressure in the air supply line 12 with a pressure sensor 33, and triggering an alarm and/or sending a signal from the pressure sensor 33 to a third valve 21 provided in the connecting air line 22 to close the third valve 21 provided in the connecting air line 22, if the pressure in the air supply line 12 exceeds a predetermined threshold value when the third valve 21 provided in the connecting air line 22 is open as an indication that the first valve 20 provided in air return line 16 upstream of the intermediate leakage tank 19 leaks and so as to prevent the pressure in the air chamber 8 circumferentially provided around the propeller shaft 1 to raise too much and so as to prevent damage of the air chamber 8.

The method comprises preferably, but not necessarily, discharging compressed air out of the air return line 16 through a throttle valve 18. In such case, the method comprises preferably, but not necessarily, arranging the throttle valve 18 of the air return line 16 outside the pod 2 and within the hull 3 of the ship.

The method comprises preferably, but not necessarily, monitoring the liquid level in the leakage tank 24 with a level monitor 27, and giving a signal to a drainage valve 28 arranged in fluid connection with the leakage tank 24 to effect opening of the drainage valve 28 if a predetermined threshold liquid level in the leakage tank 24 is exceeded.

The method comprises preferably, but not necessarily, providing a fourth valve 15 in the air supply line 12. In such case, the method comprises preferably, but not necessarily, arranging the fourth valve 15 of the air supply line 12 outside the pod 2 and within the hull 3 of the ship.

In the method, the air chamber 8 is preferably, but not necessarily, provided between a face seal 4 that is provided circumferentially around the propeller shaft 1 and a first seal ring 5 that is provided circumferentially around the propeller shaft 1. The face seal 4 is preferably, but not necessarily, configured separate the air chamber 8 from water surrounding the pod 2. In the method a lubricant chamber 7 can be provided between the first seal ring 5 that is provided circumferentially around the propeller shaft 1 and a second seal ring 6 that is provided circumferentially around the propeller shaft 1 so that the lubricant chamber 7 is provided circumferentially around the propeller shaft 1. If a lubricant chamber 7 is provided circumferentially around the propeller shaft 1, the method can comprise supplying lubricant in a lubricant supply line 9, preferably, but not necessarily, by means of gravity, from a lubricant tank 10 to the lubricant chamber 7 and supplying lubricant in a lubricant return line 11 from the lubricant chamber 7 to the lubricant tank 10. If the method comprises providing a lubricant tank 10 as described, the method can comprise monitoring the level of lubricant in the lubricant tank 10 by means of a first level sensor 31 and a second level sensor 32. If the method comprises providing a lubricant tank 10 and sensors 31 and 32, as described, the method can comprise providing the first level sensor 31 and the second level sensor 32 and the lubricant tank 10 within the pod housing of the pod 2. If such lubricant chamber 7 is provided circumferentially around the propeller shaft 1, the pressure in the lubricant chamber 7 is preferably, but not necessarily, 0.04 to 0.08 bar higher than a pressure in a pod housing of the pod 2 such as in a pod housing limited by a shell structure (not marked with a reference number) of the pod 2. If such lubricant chamber 7 is provided circumferentially around the propeller shaft 1, the pressure in the air chamber 8 is preferably, but not necessarily, 0.2 to 0.5 bar higher than the pressure in the lubricant chamber 7 is provided circumferentially around the propeller shaft 1.

The method comprises preferably, but not necessarily, providing the first valve 20 in the air return line 16 within the pod housing of the pod 2.

The method comprises preferably, but not necessarily maintaining essentially the same pressure within the pod 2 and within the hull 3 of the ship.

The method comprises preferably, but not necessarily, arranging the compressed air source 13 outside the pod 2 and within the hull 3 of the ship.

Next the arrangement for sealing a propeller shaft 1 located under water and some embodiments and variants of the arrangement will be described in greater detail.

In the arrangement, the propeller shaft 1 is arranged at a pod 2 that is suspended at a hull 3 of a ship. The pod 2 can be pivotable suspended at the hull 3 of a ship.

The arrangement comprises an air chamber 8 that is provided circumferentially around the propeller shaft 1, an air supply line 12 configured to supply compressed air from a compressed air source 13 to the air chamber 8, and an air return line 16 configured to discharge compressed air from the air chamber 8 and out of the air return line 16. Compressed air means in this context air, gas, or any mixture thereof.

The pressure in the air chamber 8 is provided circumferentially around the propeller shaft 1 is preferably, but not necessarily, about 0.2 to about 0.6 bar higher than a pressure in a pod housing of the pod 2 such as in a pod housing limited by a shell structure (not marked with a reference number) of the pod 2.

The pressure of the compressed air supplied from the compressed air source 12 to the air supply line can be in the range of about 3 to about 10 bar.

The arrangement comprises an intermediate leakage tank 19 that is in fluid connection with the air return line 16 and that is configured to collect liquid present in the compressed air in the air return line 16. The intermediate leakage tank 19 is provided within a pod housing of the pod 2.

The arrangement comprises a drainage arrangement comprising a first valve 20 in the air return line 16 upstream of the intermediate leakage tank 19, a leakage tank 24 that can be provided within the hull 3 of the ship and that is in fluid connection with the intermediate leakage tank 19 by means of a connecting liquid line 25, and a connecting air line 22 in fluid connection with the intermediate leakage tank 19. The drainage arrangement is configured to close the first valve 20 that is provided in the air return line 16 upstream of the intermediate leakage tank 19, and to supply compressed air to the connecting air line 22 to effect flowing of liquid present in the intermediate leakage tank 19 to the leakage tank 24 in the connecting liquid line 25. The pressure of the compressed air that is supplied to the intermediate leakage tank 19 effect flowing of liquid present in the intermediate leakage tank 19 in to a leakage tank 24 is preferably, but not necessarily, in the range of about 1 bar to about 3 bar. The arrangement allows thus to drain the intermediate leakage tank 19 in a controller manner without a need to entering the pod 2, provided that the leakage tank 24 is provided within the hull 3 of the ship. Alternatively, the leakage tank 24 can be provided within the pod housing of the pod 2 in a location that is easily accessible. The arrangement for sealing the propeller shaft is preferably, but not necessarily, configured to supply compressed air from the compressed air source 13 to the air chamber 8 in the air supply line 12 so that a sufficient pressure against water surrounding the pod is maintained in the air chamber 8 circumferentially surrounding the propeller shaft 8 during the described function of the drainage arrangement. The drainage arrangement is preferably, but not necessarily, configured to close the first valve 20 that is provided in the air return line 16 upstream of the intermediate leakage tank 19, and to supply compressed air to the connecting air line 22 to effect flowing of liquid present in the intermediate leakage tank 19 to the leakage tank 24 in the connecting liquid line 25, in regular time intervals such as once every hour.

Figure 2:
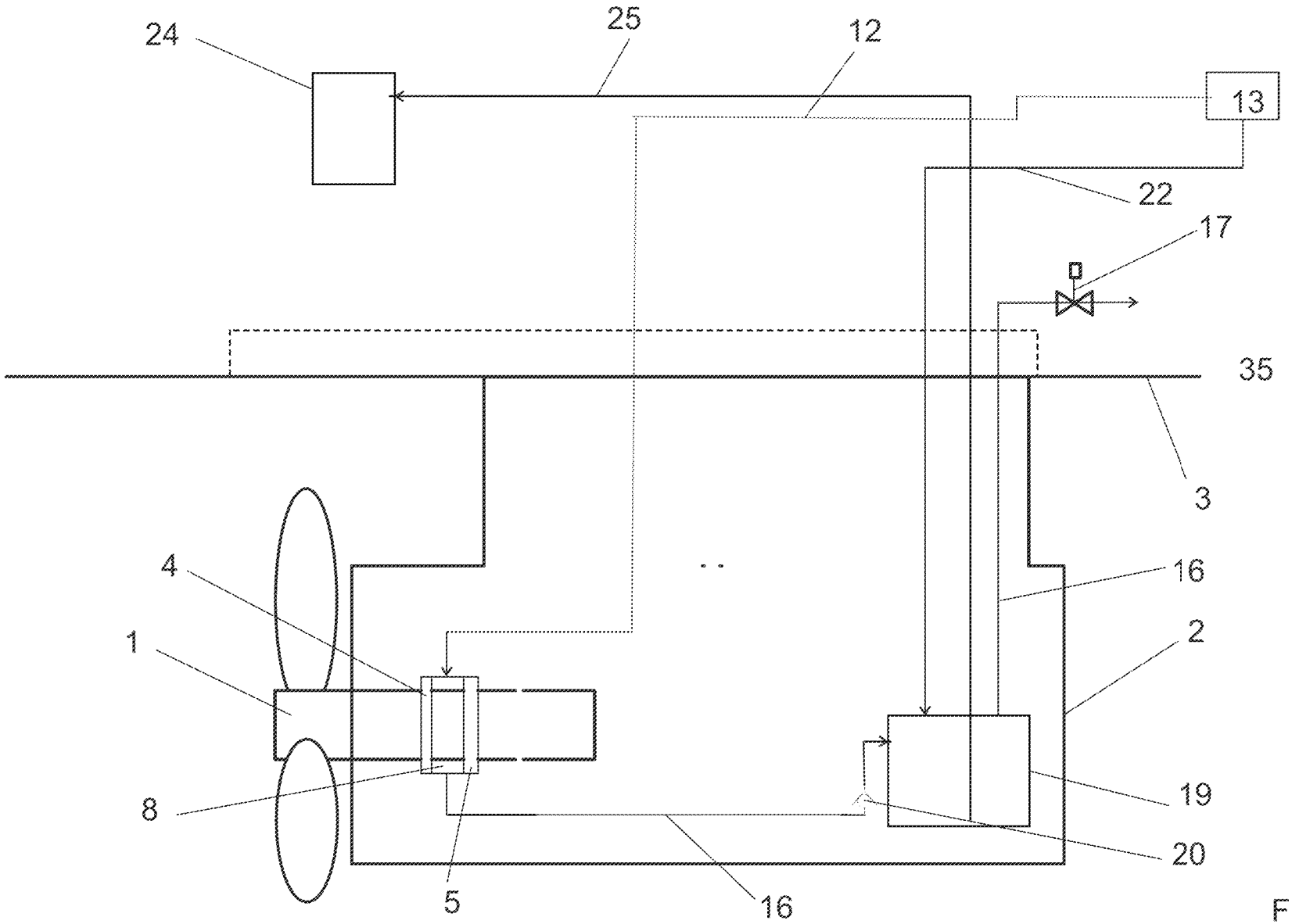
FIG. 2 is a schematic illustration of a second embodiment of the invention.
Figure 3:
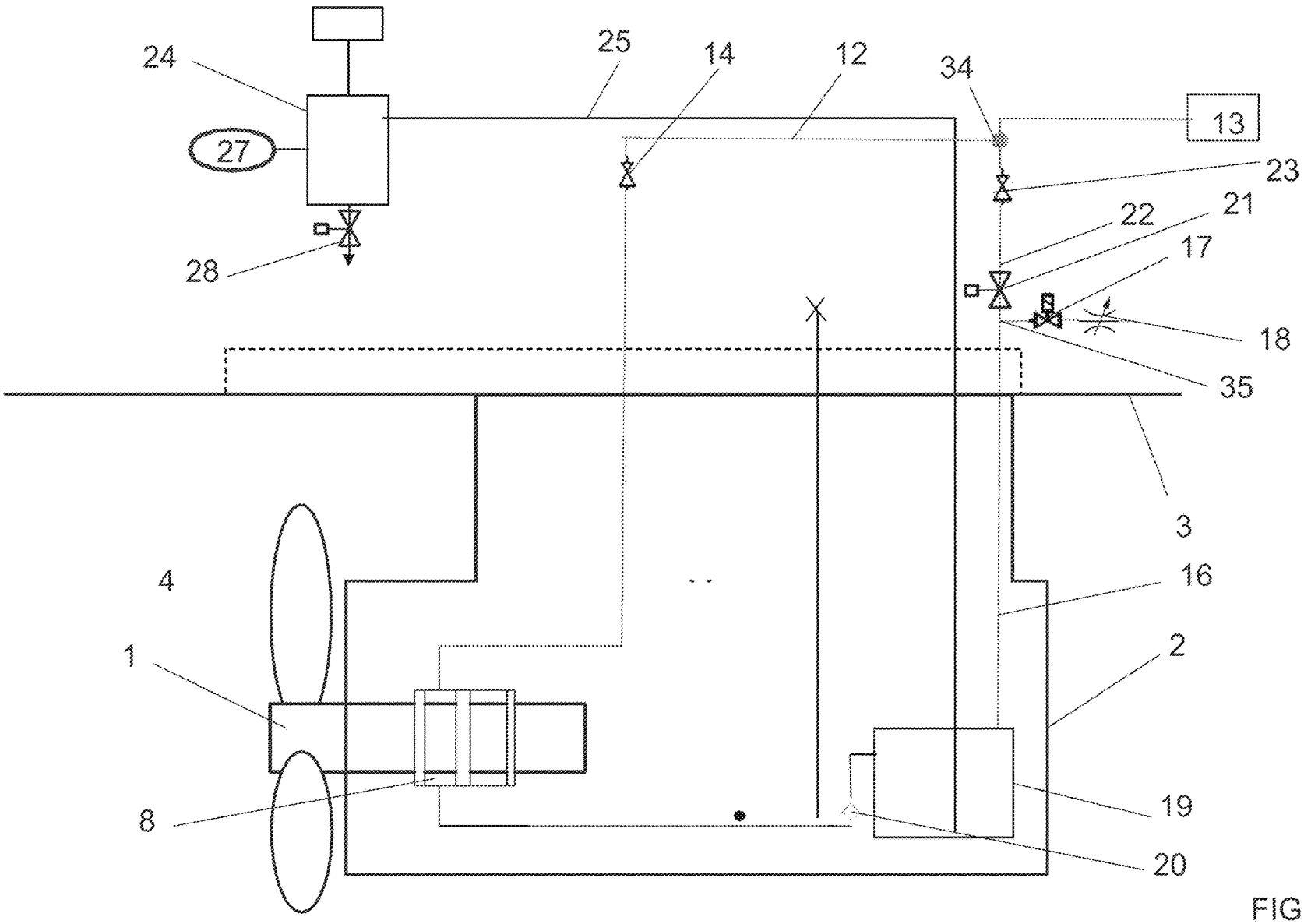
FIG. 3 is a schematic illustration of a third embodiment of the invention.
Figure 4:
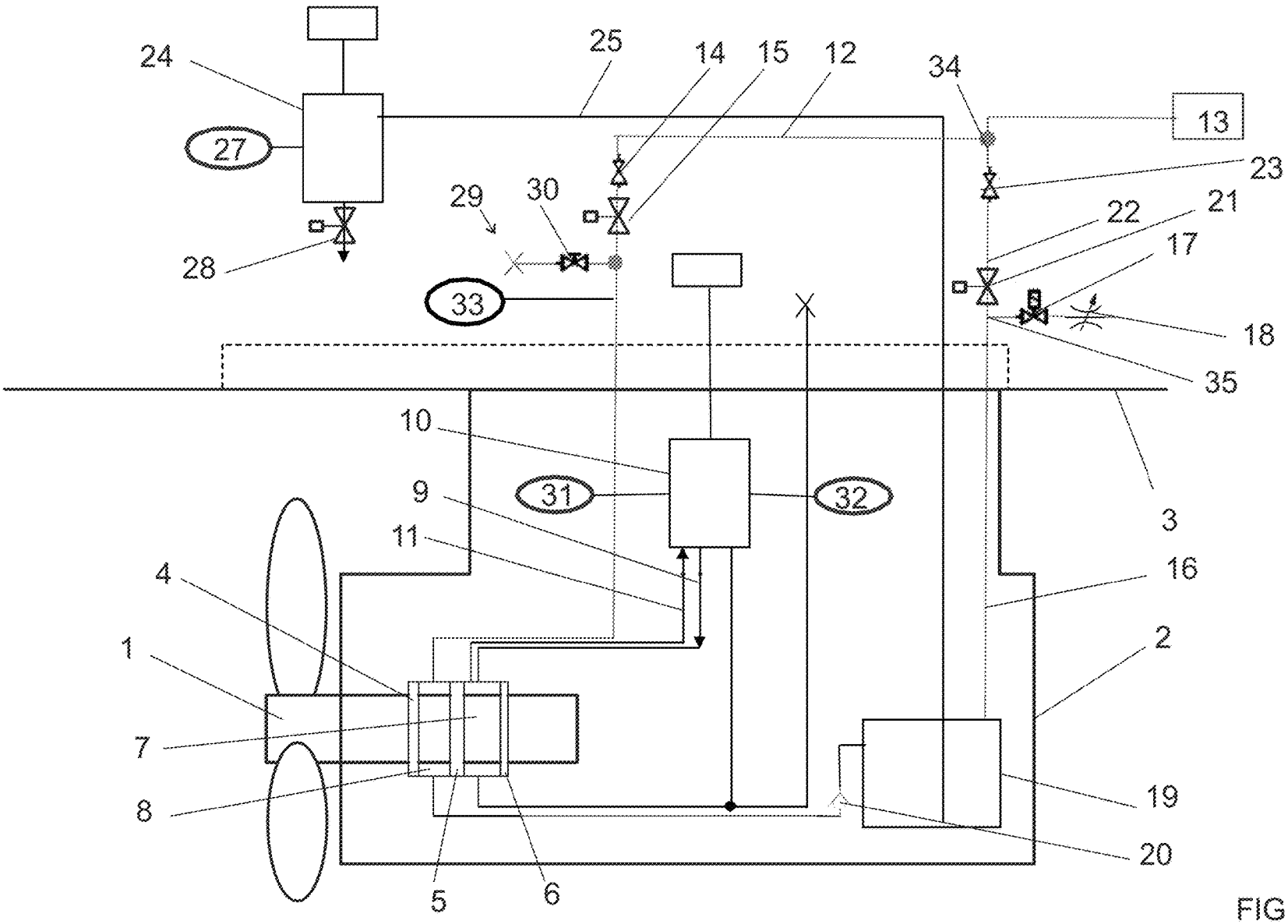
FIG. 4 is a schematic illustration of a fourth embodiment of the invention.

The drainage arrangement comprises preferably, but not necessarily, as illustrated in FIGS. 2 to 4, a second valve 17 in the air return line 16 downstream of the intermediate leakage tank 19 and the drainage arrangement preferably, but not necessarily, is configured to close the second valve 17 in the air return line 16 in connection with the closing of the first valve 20 in the air return line 16. Such second valve 17 prevents fluid from being discharged out of the air return line 16 when supplying pressurized air in the connecting air line 22 to the intermediate leakage tank 19.

In some embodiments of the arrangement the connecting air line 22 is, as illustrated in the FIGS. 3 and 4, in fluid connection with the intermediate leakage tank 19 so that an upstream end 34 of the connecting air line 22 is in fluid connection with the air supply line 12 that is configured to supply compressed air from the compressed air source 13 to the air chamber 8 that is provided circumferentially around the propeller shaft 1 and so that a downstream end 35 of the connection air line 22 is in fluid connection with the air return line 16 at a point downstream of the intermediate leakage tank 19 provided in the air return line 16 and upstream of a second valve 17 provided in the air return line 16 such that the drainage arrangement is configured to supply said compressed air to the upstream end 34 of the connecting air line 22 from the compressed air source 13, and from the downstream end 35 of the connecting air line 22 to the air return line 16 and in the air return line 16 to the intermediate leakage tank 19 leakage to effect said flowing of liquid present in the intermediate leakage tank 19 to the leakage tank 24 in the connecting liquid line 25. In such embodiments of the arrangement, the connecting air line 22 can be provided with a valve 21 for opening and closing the flow in the connecting air line 22. In such embodiments of the arrangement, a first pressure regulator 14 can be provided in the air supply line 12, the connecting air line 22 can be provided with a valve 21 and with a second pressure regulator 23 configured to provide a higher pressure than the first pressure regulator 14 that is provided in the air supply line 12, and the first valve 20 in the air return line 16 upstream of the intermediate leakage tank 19 can be in the form of a check valve, wherein the drainage arrangement is configured to open the third valve 21 provided in the connecting air line 22 to supply compressed air through the second pressure regulator 23 in the connecting air line 22 and in the air return line 16 into the intermediate leakage tank 19 to effect closing of the first valve 20 provided in the air return line 16 and to effect flowing of liquid present in the intermediate leakage tank 19 to the leakage tank 24 in the connecting liquid line 25. FIGS. 3 and 4 illustrates such embodiments. The possible first pressure regulator 14 in the air supply line 12 is preferably, but not necessarily, arranged outside the pod 2 and within the hull 3 of the ship. The possible second pressure regulator 23 and/or the possible third valve 21 are preferably, but not necessarily, arranged outside the pod 2 and within the hull 3 of the ship. If the connecting air line 22 is provided with a valve 21 for opening and closing the flow in the connecting air line 22, the arrangement comprises preferably, but not necessarily, a pressure sensor 33 connected to the air supply line 12, whereby the arrangement is configures to send a signal from the pressure sensor 33 to the third valve 21 provided in the connecting air line 22 of the drainage circuit arrangement and triggering an alarm and closing the third valve 21 provided in the connecting air line 22 of the drainage arrangement if the pressure in the air supply line 12 exceeds a predetermined threshold value when the third valve 21 provided in the connecting air line 22 of the drainage arrangement is open as an indication that the first valve 20 leaks so as to prevent the pressure in the air chamber 8 circumferentially provided around the propeller shaft 1 to raise too much and so as to prevent damage of the air chamber 8.

The face seal 4 is preferably, but not necessarily, configured separate the air chamber 8 from water surrounding the pod.

The air return line 16 is preferably, but not necessarily, configured to discharge compressed air out of through a throttle valve 18. The throttle valve 18 of the air return line 16 is preferably, but not necessarily, arranged outside the pod 2 and within the hull 3 of the ship.

The arrangement comprises preferably, but not necessarily, a level monitor 27 configured to monitor the liquid level in the leakage tank 24, wherein the level monitor is configured to give a signal to a drainage valve 28 to effect opening of a drainage valve 28 of the leakage tank 24 if a predetermined threshold liquid level in the leakage tank 24 is exceeded.

The arrangement comprises preferably, but not necessarily, a fourth valve 15 in the air supply line 12. The fourth valve 15 of the air supply line 12 is preferably, but not necessarily, arranged outside the pod 2 and within the hull 3 of the ship. If the arrangement comprises a fourth valve 15 of the air supply line 12, the arrangement can comprise a flushing circuit arrangement configured to feed water into the air supply line 12 downstream of the fourth valve 15 into the air supply line 12, wherein the flushing circuit arrangement comprises a water source 29, a valve 30 downstream of the water source 29 and upstream of the air supply line 12, and wherein the flushing circuit arrangement being configured to close the fourth valve 15 of the air supply line 12 and to open the valve 30 so as to feed water into the air supply line 12 and via the air chamber 8 that circumferentially surrounds the propeller shaft 1 in the air return line 16. FIG. 4 illustrates a such embodiment. The water source and the valve 30 are preferably, but not necessarily, provided outside the pod 2 and within the hull 3 of the ship.

The chamber 8 is preferably, but not necessarily, provided between a face seal 4 that is provided circumferentially around the propeller shaft 1 and a first seal ring 5 that is provided circumferentially around the propeller shaft 1. The arrangement comprises preferably, but not necessarily, a lubricant chamber 7 provided between the first seal ring 5 that is provided circumferentially around the propeller shaft 1 and a second seal ring 6 that is provided circumferentially around the propeller shaft 1, wherein the lubricant chamber 7 is provided circumferentially around the propeller shaft 1. The arrangement comprises preferably, but not necessarily, a lubricant supply line 9 configured to supply lubricant, preferably, but not necessarily by means of gravity, from a lubricant tank 10 to the lubricant chamber 7 and a lubricant return line 11 configured to supply lubricant from the lubricant chamber 7 to the lubricant tank 10. FIG. 4 illustrates a embodiment. A first level sensor 31 and a second level sensor 32 are preferably, but not necessarily, configured to monitor the level of lubricant in the lubricant tank 10. The possible first level sensor 31 and the possible second level sensor 32 and the possible lubricant tank 10 are preferably, but not necessarily, provided within the pod housing of the pod 2. If such lubricant chamber 7 is provided circumferentially around the propeller shaft 1, the pressure in the lubricant chamber 7 is preferably, but not necessarily, 0.04 to 0.08 bar higher than a pressure in a pod housing of the pod 2 such as in a pod housing limited by a shell structure (not marked with a reference number) of the pod 2. If such lubricant chamber 7 is provided circumferentially around the propeller shaft 1, the pressure in the air chamber 8 is preferably, but not necessarily, 0.2 to 0.5 bar higher than the pressure in the lubricant chamber 7 is provided circumferentially around the propeller shaft 1.

The first valve 20 in the return air line 16 is preferably, but not necessarily, provided within the pod 2 housing of the pod 2.

The arrangement is preferably, but not necessarily, configured to maintain essentially the same pressure within the pod 2 and within the hull 3 of the ship.

The compressed air source 13 is preferably, but not necessarily, arranged outside the pod 2 and within the hull 3 of the ship.

The possible second valve 17 in the air return line 16 downstream of the intermediate leakage tank 19 is preferably, but not necessarily, arranged outside the pod 2 and within the hull 3 of the ship.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A method for sealing a propeller shaft located under water, wherein the propeller shaft is arranged at a pod that is suspended at a hull of a ship and wherein an air chamber is provided circumferentially around the propeller shaft, the method comprising supplying compressed air from a compressed air source in an air supply line to the air chamber, discharging compressed air from the air chamber in an air return line and out of the air return line, and colleting liquid present in the compressed air discharged from the air chamber in an intermediate leakage tank that is provided in the air return line within a pod housing of the pod, wherein by closing the air return line upstream of the intermediate leakage tank, and by supplying compressed air to the intermediate leakage tank to effect flowing of liquid present in the intermediate leakage tank to a leakage tank.

2. The method according to claim 1, wherein by closing the air return line downstream of the intermediate leakage tank in connection with closing the air return line.

3. The method according to claim 2, wherein by supplying said compressed air to the intermediate leakage tank by supplying compressed air to an upstream end of a connecting air line from the air supply line, and by supplying compressed air from a downstream end the connecting air line to the air return line at a point of the air return line downstream of the intermediate leakage tank, and by supplying compressed air in the air return line to the intermediate leakage tank to effect said flowing of liquid present in the intermediate leakage tank to the leakage tank in the connecting liquid line.

4. The method according to claim 3, wherein by providing a first valve in the form of a check valve in the air return line upstream of the intermediate leakage tank, by supplying compressed air from the compressed air source to the air chamber through a first pressure regulator in the air supply line, by supplying compressed air in the connecting air line through a third valve and through a second pressure regulator configured to provide a higher pressure than the first pressure regulator, and by said closing of the air return line upstream of the intermediate leakage tank is affected by a difference between the pressure provided by the first pressure regulator and the pressure provided by the second pressure regulator causing the first valve in the form of a check valve to close.

5. The method according to claim 4, wherein by sending a signal from a pressure sensor functionally connected to the air supply line to the third valve provided in the connecting air line and triggering an alarm and/or closing the third valve provided in the connecting air line if the pressure in the air supply line exceeds a predetermined threshold value when the third valve provided in the connecting air line is open.

6. An arrangement for sealing a propeller shaft located under water, wherein the propeller shaft is arranged at a pod that is suspended at a hull of a ship comprising:

an air chamber that is provided circumferentially around the propeller shaft, an air supply line configured to supply compressed air from a compressed air source to the air chamber, an air return line configured to discharge compressed air from the air chamber and out of the air return line, and an intermediate leakage tank for collecting liquid present in the air is provided in the air return line, wherein the intermediate leakage tank being provided within a pod housing of the pod, by a drainage arrangement including:

a first valve in the air return line upstream of the intermediate leakage tank, a leakage tank in fluid connection with the intermediate leakage tank by means of a connecting liquid line, and a connecting air line in fluid connection with the intermediate leakage tank, the drainage arrangement configured to close the first valve in the air return line, to supply compressed air in the connecting air line to the intermediate leakage tank to effect flowing of liquid present in the intermediate leakage tank to the leakage tank in the connecting liquid line.

7. The arrangement according to claim 6, wherein the drainage arrangement comprises a second valve in the air return line downstream of the intermediate leakage tank, and the drainage arrangement being configured to close the second valve in the air return line in connection with the closing of the first valve in the air return line.

8. The arrangement according to claim 7, wherein the connecting air line being in fluid connection with the intermediate leakage tank so that an upstream end of the connecting air line is in fluid connection with the air supply line and so that a downstream end of the connection air line is in fluid connection with the air return line at a point upstream of the second valve in the air return line and downstream of the intermediate leakage tank, and the drainage arrangement being configured to supply said compressed air to the upstream end of the connecting air line from the compressed air source that is configured to supply compressed air to the air chamber that is provided circumferentially around the propeller shaft, and from downstream end of the connecting air line to the air return line and in the air return line to the intermediate leakage tank leakage to effect said flowing of liquid present in the intermediate leakage tank to the leakage tank in the connecting liquid line.

9. The arrangement according to claim 8, wherein the connecting air line being provided with a third valve, and the drainage arrangement being configured to open the third valve provided in the connecting air line to supply compressed air to the intermediate leakage tank to effect flowing of liquid present in the intermediate leakage tank to the leakage tank in the connecting liquid line.

10. The arrangement according to claim 8, including:

a first pressure regulator in the air supply line, and the connecting air line being provided with a third valve and with a second pressure regulator configured to provide a higher pressure than the first pressure regulator, and the drainage arrangement being configured to open the third valve provided in the connecting air line to supply compressed air through the second pressure regulator in the connecting air line and in the air return line into the intermediate leakage tank to effect flowing of liquid present in the intermediate leakage tank to the leakage tank in the connecting liquid line.

11. The arrangement according to claim 8, including:

a first pressure regulator in the air supply line, the connecting air line being provided with a third valve and with a second pressure regulator configured to provide a higher pressure than the first pressure regulator, the first valve in the air return line upstream of the intermediate leakage tank being in the form of a check valve, and the drainage arrangement being configured to open the third valve provided in the connecting air line to supply compressed air through the second pressure regulator in the connecting air line and in the air return line into the intermediate leakage tank to effect closing of the first valve and to effect flowing of liquid present in the intermediate leakage tank to the leakage tank in the connecting liquid line.

12. The arrangement according to claim 9, including:

connecting a pressure sensor to the air supply line, and sending a signal from the pressure sensor to the third valve provided in the connecting air line of the drainage circuit arrangement and triggering an alarm and closing the third valve provided in the connecting air line of the drainage circuit arrangement if the pressure in the air supply line exceeds a predetermined threshold value when the third valve provided in the connecting air line of the drainage circuit arrangement is open.

13. The arrangement according to claim 6, including a lubricant chamber provided between a first seal ring provided circumferentially around the propeller shaft and a second seal ring that is provided circumferentially around the propeller shaft, wherein the lubricant chamber is provided circumferentially around the propeller shaft.

14. The arrangement according to claim 13, wherein the air chamber provided between a face seal provided circumferentially around the propeller shaft and the first seal ring.

15. The arrangement according to claim 13, including a lubricant supply line configured to supply lubricant from a lubricant tank to the lubricant chamber and a lubricant return line configured to supply lubricant from the lubricant chamber to the lubricant tank.

* * * * *